US006913336B2

(12) United States Patent
Hara

(10) Patent No.: US 6,913,336 B2
(45) Date of Patent: Jul. 5, 2005

(54) INK JET RECORDING APPARATUS AND INK END JUDGING METHOD EXECUTED IN THE SAME

(75) Inventor: Kazuhiko Hara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 163 days.

(21) Appl. No.: 10/122,132

(22) Filed: Apr. 15, 2002

(65) Prior Publication Data

US 2002/0158925 A1 Oct. 31, 2002

(30) Foreign Application Priority Data

Apr. 13, 2001 (JP) ..... P2001-114884

(51) Int. Cl.[7] ..... B41J 2/195
(52) U.S. Cl. ..... 347/7
(58) Field of Search ..... 347/7, 23

(56) References Cited

U.S. PATENT DOCUMENTS 6,012,794 A * 1/2000 Nakano et al. ..... 347/7
6,070,958 A 6/2000 Kanome

FOREIGN PATENT DOCUMENTS

| | | |
|---|---|---|
| EP | 0 841 173 A2 | 5/1998 |
| JP | 5-16384 | 1/1993 |
| JP | 09-011490 A | 1/1997 |
| JP | 11-10900 A | 1/1999 |

* cited by examiner

*Primary Examiner*—Michael S. Brooke
(74) *Attorney, Agent, or Firm*—Sughrue Mion, PLLC

(57) ABSTRACT

In order to judge an ink end state of at least one of ink cartridges detachably mounted on a recording head incorporated in an ink jet recording apparatus, a consumed ink amount in each ink cartridge is counted. When the counted consumed ink amount of one ink cartridge reaches a first value indicating the ink end state, a count value is added to the counted consumed ink amounts of any other ink cartridges, in order to obtain verification count values. When at least one of the verification count values reaches a second value which is less than the first value, it is judged that the ink cartridge in which the verification count value reaches the second value is in the ink end state.

22 Claims, 10 Drawing Sheets

| Cb | INK STATUS | DISPLAY |
|---|---|---|
| LESS THAN C | 0 | - |
| C OR MORE | 1 | NEAR INK END |
| B OR MORE | 2 | NEAR INK END |
| A OR MORE | 3 | INK END |

| Cb | INK STATUS | DISPLAY |
|---|---|---|
| LESS THAN C | 0 | - |
| C OR MORE | 1 | NEAR INK END |
| B OR MORE | 3 | INK END |

INK JET RECORDING APPARATUS AND INK END JUDGING METHOD EXECUTED IN THE SAME

BACKGROUND OF THE INVENTION

This invention relates to an ink jet recording apparatus comprising an ink jet recording head for ejecting ink droplets in response to print data and ink cartridges for each color placed thereon replaceably, and in particular to a management technique of the remained ink amount in each of the ink cartridges.

For example, an ink jet recording apparatus of a serial printing system comprises: an ink jet recording head mounted on a carriage and moving in a main scanning direction; and a paper feeder for transporting recording paper in a subscanning direction orthogonal to the main scanning direction, and ejects ink drops through the recording head based on print data, thereby printing on the recording paper.

In a relatively small-sized recording apparatus intended for home use, ink cartridges for supplying ink to a recording head are detachably placed on a carriage. The recording apparatus comprises a consumed ink amount calculator for counting the consumed amount of ink stored in each ink cartridge, thereby calculating the consumed ink amount in each ink cartridge and when the consumed (counted) amount of ink in any ink cartridge reaches a predetermined value, it is judged that the ink cartridge is an ink end state.

In the recording apparatus, to replace the ink cartridge based on the ink end, the ink cartridge in the ink end state is drawn out from the cartridge holder on the carriage and a new ink cartridge is inserted into the cartridge holder on the carriage.

In this case, in this kind of recording apparatus, hollow ink introduction needles are extended upward in the bottom of the cartridge holder. To place a new ink cartridge, an ink supply port of the ink cartridge is pushed into the ink introduction needle, whereby the ink supply port of the ink cartridge is joined to the ink introduction needle and ink is supplied from the ink cartridge to the recording head mounted on the carriage.

If the ink cartridge is replaced as described above, a problem of air entering through the hollow ink introduction needle and trapping air in the ink introduction needle occurs. A part of the trapped-in air moves into the recording head on the ink flow produced by the print operation, etc., and creates a bottleneck in the normal ink droplet ejection from the recording head, causing a print failure to occur.

Thus, a capping member capable of sealing the nozzle formation face of the recording head is provided and a negative pressure is applied in the capping member by a suction pump, whereby ink is sucked from the recording head and at the same time the air trapped in the ink flow passage is discharged. Such ink suction and discharging operation performed after ink cartridge replacement is called replacement cleaning operation.

By the way, most of the above-described recording apparatus are configured so that black ink, yellow ink, cyan ink, and magenta ink, for example, supplied from the cartridges are ejected through nozzle rows formed on one recording head. When the above-described replacement cleaning operation is executed, one capping member sealing the nozzle formation face sucks a relatively large amount of each color ink.

Therefore, if a first cartridge of one color is in the ink end state and is replaced with a new cartridge and the replacement cleaning operation is executed, a situation in which the ink end state is established as the replacement cleaning is executed can occur in a second cartridge having a small ink amount. Further, if replacement cleaning is again executed as the second cartridge is replaced with a new cartridge, a state in which a third cartridge reaches the ink end state can also occur.

When one color cartridge is replaced and the suction operation is executed, although other cartridges do not reach the ink end, if the print operation is restarted, a state in which as slight print operation is executed, any other cartridge is in the ink end state and must again be replaced with a new cartridge can also occur.

FIGS. 12 to 15 schematically show the situation in which the above-described state can occur, wherein the consumed (counted) amount of ink in each color cartridge is hatched. Therefore, the count indicates the ink end state, the corresponding ink cartridge is assumed to reach the ink end. For example, if black ink is in the ink end state (count A) as shown in FIG. 12, the black ink cartridge is replaced.

As the suction operation is executed when the black ink cartridge is replaced, the consumed (counted) ink amounts of cyan, magenta, and yellow are incremented by cc, mm, and yy, as shown in FIG. 13. As print is executed in this state, when each counter is further incremented by pp accompanying a slight print amount, the yellow ink cartridge reaches the ink end state as shown in FIG. 14.

Then, if the yellow ink cartridge is replaced, the suction operation is again executed and the consumed (counted) ink amounts of black, cyan, and magenta are incremented by bb, cc, and mm accordingly, as shown in FIG. 15. In the state as shown in FIG. 15, if print is further restarted, the magenta ink reaches the ink end state as slight print operation is executed, and again the ink cartridge (in this case, magenta ink cartridge) must be replaced.

Therefore, if the ink consumption situation as described above occurs, the second cartridge must be replaced immediately after the first cartridge is replaced, and after the second cartridge is replaced, it becomes necessary to replace the third cartridge, resulting in rasping the user's nerves. Moreover, the ink suction operation needs to be executed whenever the ink cartridge is replaced, and consequently the ink in each cartridge is wasted.

SUMMARY OF THE INVENTION

It is therefore an object of the invention to provide an ink jet recording apparatus and an ink end judging method executed in the recording apparatus capable of preventing occurrence of a situation in which ink cartridge replacement must be conducted frequently and preventing the user from receiving an unpleasant feeling.

In order to achieve the above object, according to the present invention, there is provided an ink jet recording apparatus comprising:

- a recording head, which ejects ink drops;
- a plurality of ink cartridges detachably mounted on the recording head to supply ink thereto, each associated with at least one color of ink;
- a consumed ink amount counter, which counts a consumed ink amount in each ink cartridge;
- a verifier, which adds a count value, when the counted consumed ink amount of one ink cartridge reaches a first value indicating an ink end state, to the counted consumed ink amounts of any other ink cartridges, in order to obtain verification count values;

a determinant, which judges, when at least one of the verification count values reaches a second value which is less than the first value, that the ink cartridge in which the verification count value reaches the second value is in the ink end state, In this case, it is desirable that the added count value corresponds to an ink amount consumed in an ink suction operation for sucking ink from the recording head which is executed after performing replacement of the ink cartridge.

In this apparatus, when the ink suction operation (replacement cleaning) is executed, whether or not any other ink cartridge comes near the ink end state can be checked.

Preferably, the following relationships are satisfied:

$$A-B \leqq N \cdot C1$$

$$N \leqq m-2$$

where A represents the first value; B represents the second value; C1 represents the added count value; N is a natural number; and m is number of the ink cartridge.

That is, as the relation is set as mentioned above, the ink amount wasted by the replacement cleaning executed when any ink cartridge is in the ink end state can be suppressed. Assuming a recording apparatus in which four color ink cartridges of black, yellow, cyan, and magenta are placed, the probability that the three color ink cartridges will reach the ink end at the same time is low. Therefore, setting (m−2) becomes practically an appropriate value considering the probability.

Preferably, the following relationship is satisfied:

$$A-B \leqq n \cdot Cf$$

where A represents the first value; B represents the second value; n represents a natural number; and Cf represents a count value corresponding to an ink amount consumed either one of when the recording apparatus is activated, when an ink suction operation for sucking ink from the recording head is performed or when a flushing operation for idly ejecting inkdrops is performed.

If the recording apparatus is set to the relation, the disadvantage can be suppressed that another ink cartridge is in the ink end state as the initial cleaning operation performed when the apparatus is activated, the timer cleaning operation is periodically executed, or the flushing operation is periodically performed during the print operation, which are programmed in the recording apparatus. Therefore, the problem for the user to have to replace an additional ink cartridge as each above-mentioned operation programmed in the recording apparatus is executed can be circumvented.

Preferably, the following relationship is satisfied:

$$A-C > C1$$

where A represents the first value; C represents a third value which is less than the second value; and C1 represents the added count value.

If the near ink end state is indicated as described later, the user can recognize that sufficient amount of ink is remained in the ink cartridge with respect to the ink end state. Therefore, the user can recognize that it is possible to print to some extent still after ink cartridge replacement. In other words, if the user intends to execute a large amount of print, he or she can also replace the ink cartridge reaching the near ink end at the same time.

Here, it is preferable that the ink jet recording apparatus further comprises an indicator which indicates there is at least one ink cartridge which Is judged as the ink end state. The indicator may indicate there is at least one ink cartridge which is judged as the near ink end state.

In this apparatus, as the ink cartridges each assumed to reach the ink end state are replaced at a time, occurrence of the disadvantage that an additional ink cartridge is in the ink end state as the ink suction operation is executed after ink cartridge replacement can be circumvented if another ink cartridge reaches the near ink end state, replacement operation of the ink cartridge can also be selected as the user determines.

According to the present invention, there is also provided an ink jet recording apparatus comprising:

a recording head, which ejects ink drops;

a plurality of ink cartridges detachably mounted on the recording head to supply ink thereto, each associated with at least one color of ink;

a consumed ink amount counter, which counts a consumed ink amount in each ink cartridge;

a verifier, which adds a count value, when the counted consumed ink amount of one ink cartridge reaches a first value indicating an ink end state, to the counted consumed ink amounts of any other ink cartridges, in order to obtain verification count values;

a determinant which judges, when at least one of the verification count values reaches the first value, that the ink cartridge in which the verification count value reaches the first value is in the ink end state.

Preferably, the count value is obtained by adding a first count value corresponding to an ink amount consumed in an ink suction operation for sucking ink from the recording head which is executed after performing replacement of the ink cartridge and a second count value corresponding to an ink amount consumed in a specific printing operation.

In this apparatus, after the ink suction operation (replacement cleaning) is executed, additional execution of predetermined amount of print is guaranteed.

Here, it is preferable that the second count value is subtracted from the verification count value to obtain an updated count value, when the verification count value is less than the first value.

In this apparatus, the count value manipulated on the algorithm is restored to the count value indicating the actual remained ink amount. Accordingly, the reliability of the ink end judging operation continuously executed can be provided.

Preferably, the following relationships are satisfied:

$$C2 \leqq N \cdot C1$$

$$N \leqq m-2$$

where C1 represents the first count value; C2 represents the second count value; N is a natural number; and m is number of the ink cartridge.

In this apparatus, the ink amount wasted by the replacement cleaning executed when any ink cartridge is in the ink end state can be suppressed.

Preferably, the following relationship is satisfied:

$$C2 \leqq n \cdot Cf$$

where C2 represents the second count value; n represents a natural number; and Cf represents a count value corresponding to an ink amount consumed either one of when the recording apparatus is activated, when an ink suction operation for sucking ink from the recording head is performed or when a flushing operation for idly ejecting inkdrops is performed.

If the recording apparatus is set to the relation, the problem for the user to have to replace an additional ink cartridge as each periodical operation programmed in the recording apparatus is executed can be circumvented, Preferably, the following relationship is satisfied:

$$A-B>C$$

where A represents the first value; B represents a second value which is less than the first value; and C represents the added count value.

In this apparatus, if another ink cartridge leads to the ink end state as one ink cartridge is replaced, it can be previously recognized that the ink cartridge reaches the near ink end state. Therefore, it is made possible to conduct management so as to also replace the cartridge reaching the near ink end state at the same time, and the problem for the user to have to replace another ink cartridge shortly after replacing one ink cartridge can also be circumvented.

Preferably, the ink jet recording apparatus further comprises an indicator which indicates there is at least one ink cartridge which is judged as the ink end state. The indicator may indicate there is at least one ink cartridge which is judged as the near ink end state.

Accordingly, as the ink cartridges each assumed to reach the ink end state are replaced at a time, occurrence of the disadvantage that another ink cartridge is in the ink end state as slight print operation is executed can be circumvented. Further, if another ink cartridge reaches the second value, it can also be recognized that the ink cartridge is in the near ink end state, and replacement operation of the ink cartridge can also be selected as the user determines.

According to the present invention, there is also provided a method of judging an ink end state of at least one of ink cartridges detachably mounted on a recording head incorporated in an ink jet recording apparatus, comprising the steps of:

counting a consumed ink amount in each ink cartridge;

adding a count value, when the counted consumed ink amount of one ink cartridge reaches a first value indicating the ink end state, to the counted consumed ink amounts of any other ink cartridges, in order to obtain verification count values; and judging, when at least one of the verification count values reaches a second value which is less than the first value, that the ink cartridge in which the verification count value reaches the second value is in the ink end state.

According to the present invention, there is also provided a method of judging an ink end state of at least one of ink cartridges detachably mounted on a recording head incorporated in an ink jet recording apparatus, comprising the steps of:

counting a consumed ink amount in each ink cartridge;

adding a count value, when the counted consumed ink amount of one ink cartridge reaches a first value indicating an ink end state, to the counted consumed ink amounts of any other ink cartridges, in order to obtain verification count values; and judging, when at least one of the verification count values reaches the first value, that the ink cartridge in which the verification count value reaches the first value is in the ink end state.

Here, it is preferable that the judging method further comprises the step of subtracting a count value from the verification count value to obtain an updated count value, when the verification count value is less than the first value, Here, the subtracted count value corresponds to an ink amount consumed in a specific printing operation.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
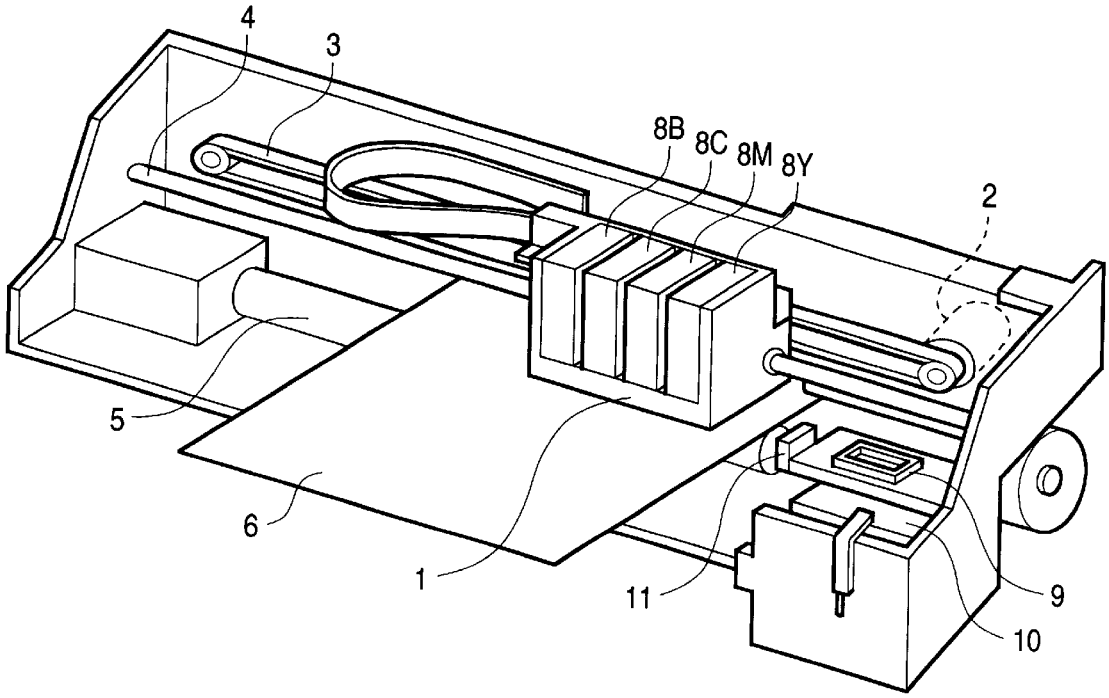
FIG. 1 is a perspective view to show the whole configuration of a recording apparatus incorporating the invention.

Referring now to the accompanying drawings, there is shown a preferred embodiment of an ink jet recording apparatus according to the invention. FIG. 1 shows the whole configuration of a recording apparatus incorporating the invention. In the figure, numeral 1 denotes a carriage and the carriage 1 is guided by a guide member 4 and is reciprocated along the longitudinal direction of a paper feeding member 5 via a timing belt 3 driven by a carriage motor 2.

A recording head 7 (described later) is mounted on the lower face of the carriage 1 opposed to the paper feeding member 5, and separate ink cartridges 8B, 8C, 8M, and 8Y capable of supplying black ink, cyan ink, magenta ink, and yellow ink respectively to the recording head 7 are detachably placed on the upper face of the carriage 1. Accordingly, ink droplets are ejected to recording paper 6 transported on the paper feeding member 5 through the recording head 7 receiving a print command, thereby executing print.

Placed in a non-print area of the recording apparatus (right in FIG. 1) is capping member 9 capable of rising when the carriage 1 moves to the area and sealing the nozzle formation face of the recording head 7 mounted on the carriage 1. At the flushing operation time, the capping member 9 faces the recording head 7 with a given gap and receives ink droplets produced by idle ejection; during quiescent operation of the recording apparatus, the capping member 9 serves as a lid for sealing the nozzle formation face of the recording head 7. Further, at the cleaning operation time, the capping member 9 can receive a negative pressure from a suction pump 10 and forcibly suck and discharge ink from the recording head 7.

A wiping member 11 comprising an elastic material such as rubber formed like a rectangle is placed in a print area contiguous to the capping member 9 When the carriage 1 is moved to the capping member 9, the wiping member 11 goes into the move path of the recording head 7 and performs the wiping operation of wiping the nozzle formation face of the recording head 7 as required.

Figure 2:
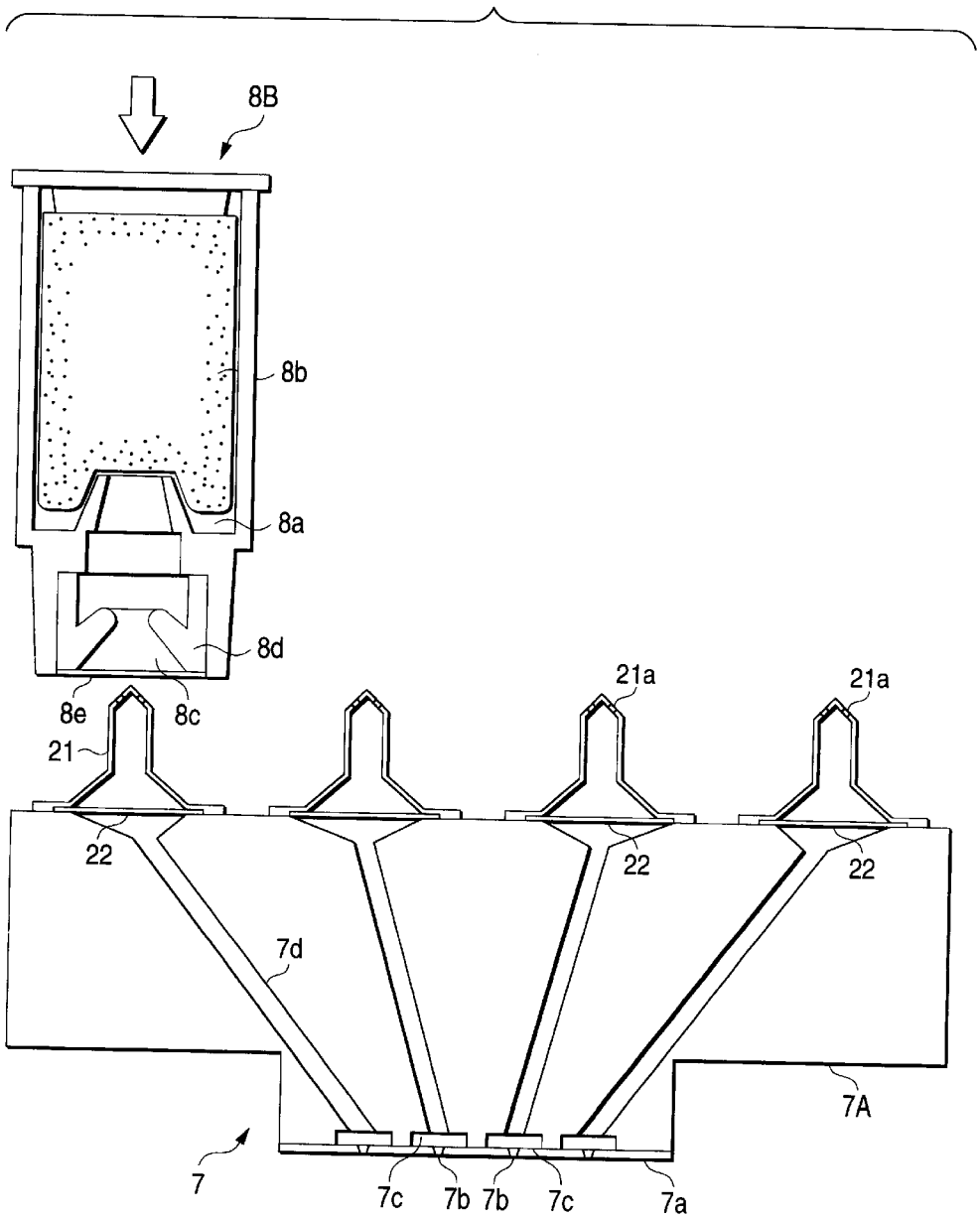
FIG. 2 is a sectional view to show the configuration of a recording head mounted on a carriage of the recording apparatus shown in FIG. 1 and an ink cartridge for supplying ink thereto.

Next, FIG. 2 shows a situation in which an ink cartridge is placed on the top of the recording head 7 mounted on the carriage 1 in a cross-sectional state. The recording apparatus in the embodiment uses four types of ink cartridges as described above; FIG. 2 shows representatively the configuration of the black ink cartridge 8B, one of the four ink cartridges.

A nozzle plate 7*a* forming the nozzle formation face is placed on the lower face of a head case 7A forming a part of the recording head 7 and is formed with a plurality of nozzle orifices 7*b* and pressure chambers 7*c* are placed in a one-to-one correspondence with the nozzle orifices 7*b*, An ink flow passage 7*d* is formed in the head case 7A upward from the portion of the nozzle orifice 7*b* and the pressure chamber 7*c*.

Four hollow ink introduction needles 21 each formed with an ink introduction hole 21*a* are placed in an upright state on the top of the head case 7A and each ink flow passage 7*d* formed in the head case 7A is made to communicate with the ink flow passage in the corresponding ink introduction needle 21. A filter member 22 is placed between each ink introduction needle and the head case 7A, thereby preventing foreign matter of dust, etc., from entering the recording head 7.

The left ink introduction needle 21 in FIG. 2 is provided for introducing black ink and the black ink cartridge 8B can be mounted toward the ink introduction needle 21 from above the ink introduction needle 21 from the arrow direction. The most of the upper part of the black ink cartridge 8B is used as an ink storage chamber 8*a* storing a porous member 8*b* impregnated with black ink for storing the ink.

An opening part 8*c* is formed in the lower part of the ink storage chamber 8*a* and a rubber seal member 8*d* is fitted into the opening part 8*c*. A film member 8*e* is put on the lower end part of the opening part 8*c* so as not to volatilize an internal ink solvent during the storage of the ink cartridge.

The black ink cartridge 8B is pushed in the arrow direction, whereby the ink introduction needle 21 penetrates the film member 8*e* and the rubber seal member 8*d* placed in the cartridge 8B is joined to the surroundings of the ink introduction needle 21, so that the cartridge 8B is placed in a mount state. Ink is supplied from the ink cartridge 8B to the recording head 7 through the ink introduction hole 21*a* made in the vicinity of the tip of the ink introduction needle 21. Other color ink storing cartridges, namely, the cyan, magenta, and yellow ink cartridges are also placed using the remaining three ink introduction needles 21 and ink is supplied to the recording head 7.

Figure 3:
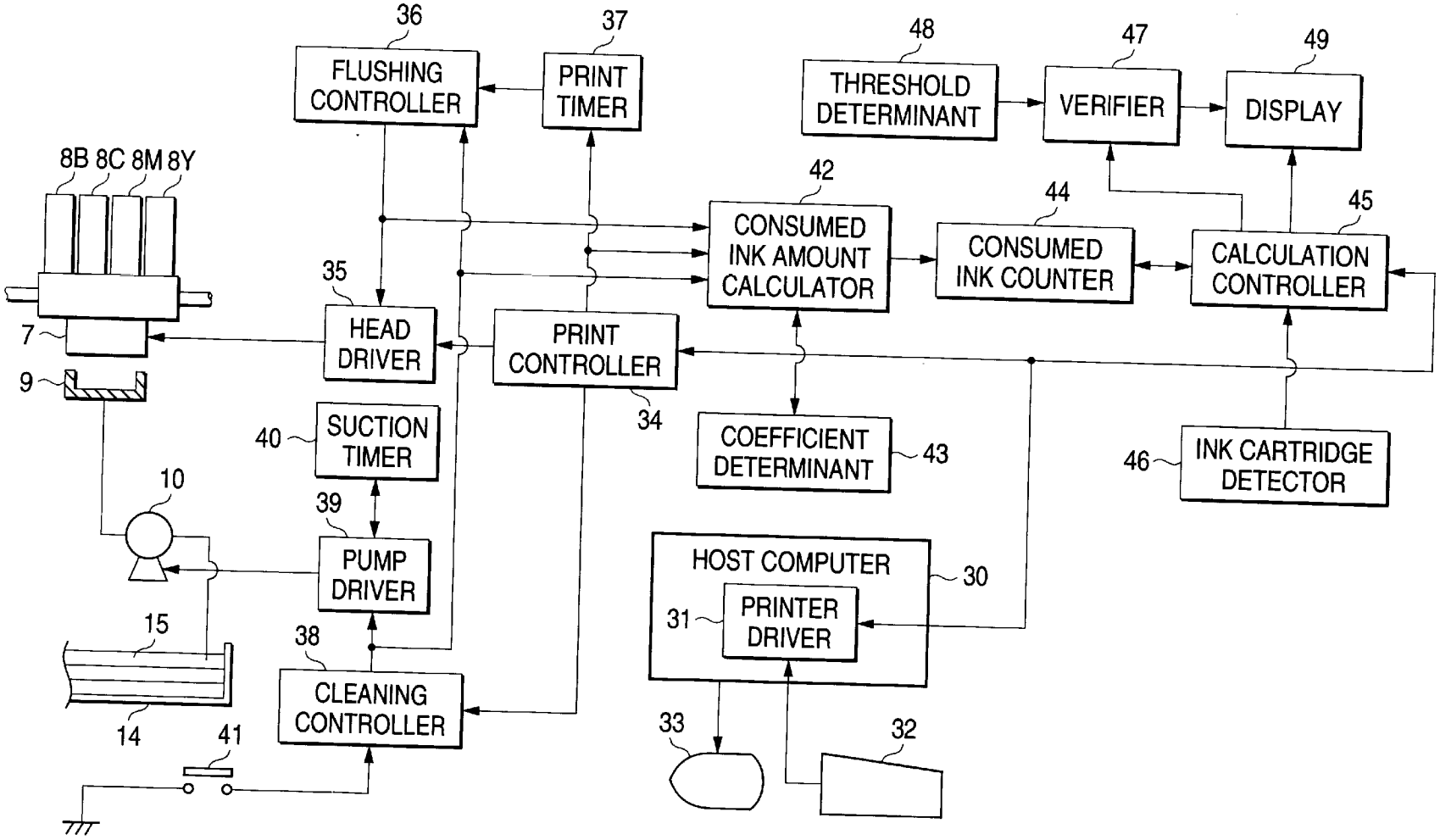
FIG. 3 is a block diagram to show the configuration of a control circuit installed in the recording apparatus shown in FIG. 1.

FIG. 3 is a block diagram to show the configuration of a control circuit installed in the recording apparatus. Parts corresponding to those previously described with reference to FIGS. 1 and 2 are denoted by the same reference numerals and therefore will not be discussed again. As shown in FIG. 3, one end of a tube of a suction pump (tube pump) 10 for sucking the internal space of the capping member 9 to a negative pressure is connected to the capping member 9, and the discharge side of the suction pump 10 is connected to a waste tank 14. The ink waste discharged into the capping member 9 by the cleaning operation, etc., is absorbed and held in a waste absorption member 15 stored in the waste tank 14.

In FIG. 3, numeral 30 denotes a host computer. A printer driver 31 is installed in the host computer 30 and known paper size, monochrome/color print selection, record mode selection, data of font, etc., a print command, or the like can be entered on utilities of the printer driver 31 in response to a command from an input unit 32.

A display 33 is connected to the host computer 30 for enabling the user to check the input state through the input unit 32 and also receive visual display of the state of the recording apparatus, for example, information indicating the remained ink amount of each ink cartridge placed in the recording apparatus, etc., as known.

On the other hand, a print controller 34 shown in FIG. 3 can generate bit map data based on print data sent from the host computer 30 and cause a head driver 35 to generate a drive signal based on the bit map data for ejecting ink droplets through the recording head 7. In addition to ejecting ink droplets based on the print data, the head driver 35 also operates so as to idly eject ink droplets upon reception of a command from a flushing controller 36.

The flushing controller 36 controls so as to execute the flushing operation (periodical flushing) when the print operation is continued for a given time period based on the time count of a print timer 37. In this case, the carriage 1 is transported to the flushing position, for example, the placement position of the capping member 9. To prevent or remove clogging of the nozzle orifices, the flushing controller 36 controls so as to idly eject a predetermined number of ink droplets through all nozzle orifices.

A cleaning controller 38 is started when it receives a control signal through the print controller 34 upon reception of a command from the host computer 30, for example, or when the user or the like, operates a cleaning switch 41 placed on an operation panel of the recording apparatus. With the recording head 7 sealed with the capping member 9, the cleaning controller 38 outputs a control signal to a pump driver 39 for driving the suction pump 10 in the time set in a suction timer 40, thereby performing manual cleaning operation of sucking and discharging ink from the nozzle orifices of the recording head 7. In addition, the cleaning controller 38 also serves so as to execute initial cleaning operation performed when the operation power of the recording apparatus is turned on, timer cleaning operation performed at a predetermined cycle, replacement cleaning operation performed when an ink cartridge is replaced, or the like.

A consumed ink amount calculator 42 has a function of calculating the consumed amount of ink stored in each ink cartridge. It counts the number of ink droplets ejected by the print operation and the flushing operation and multiplies the number of ink droplets by the ink amount per droplet, stored in a coefficient determinant 43 to calculate the consumed ink amount. At the cleaning operation time, the consumed ink amount calculator 42 also calculates the ink amount ejected from the recording head 7 at the stage at which a suction command is output to the pump driver 39.

The count concerning the consumed ink amount calculated by the consumed ink amount calculator 42 is sent to a consumed ink counter 44 for managing the remained ink amount of each ink cartridge placed in the recording apparatus. The consumed ink counter 44 can bidirectionally communicate data with a calculation controller 45. A control signal from an ink cartridge detector 46 is supplied to the calculation controller 45.

The ink cartridge detector 46 detects each ink cartridge being placed in or detached from the carriage 1. For example, when sensing that an ink cartridge is removed as it is replaced, the ink cartridge detector 46 sets an ink cartridge replacement flag.

Although the detailed function of the calculation controller 45 is described later, the data concerning the ink consumption count from the consumed ink counter 44 and the data (flag) from the ink cartridge detector 46 are supplied to the calculation controller 45. As an ink cartridge is replaced, the calculation controller 45 resets to zero the ink consumption count corresponding to the ink cartridge. When a predetermined count is added in the judging operation of the ink end, etc., as described later, the calculation controller 45 rewrites the data in the consumed ink counter 44.

The data from the consumed ink counter 44 is supplied through the calculation controller 45 to a verifier 47. Threshold information from a threshold determinant 48 is provided to the verifier 47. Then, the verifier 47 compares the threshold information from the threshold determinant 48 with the data from the consumed ink counter 44 and displays the state of each ink cartridge on a display 49.

Figure 4:
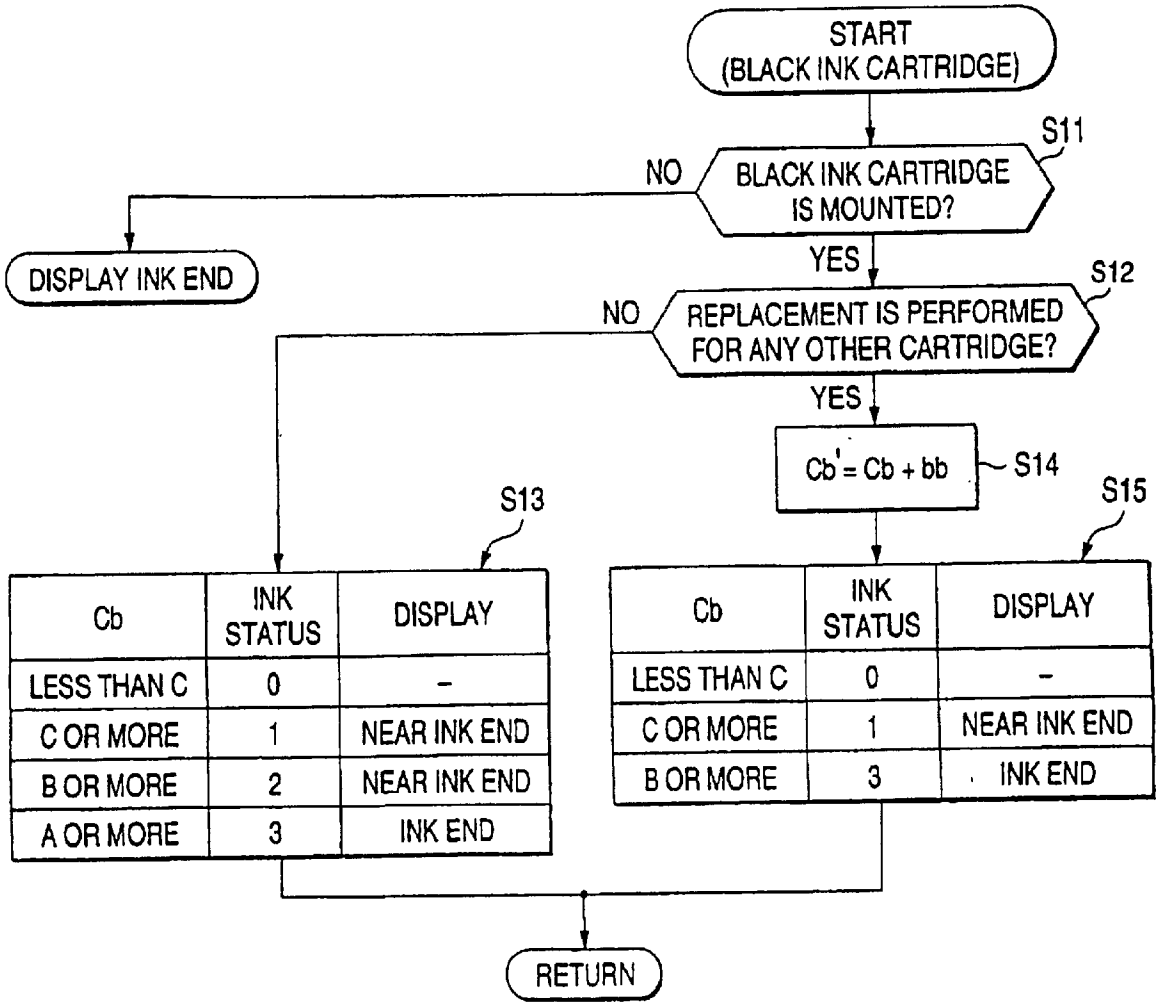
FIG. 4 is a flowchart to show a control routine for executing remained ink amount management in each ink cartridge by the control circuit shown in FIG. 3, according to a first embodiment of the invention.

FIG. 4 shows a control routine for managing the remained ink amount of each ink cartridge by the described recording apparatus, according to a first embodiment of the invention. FIG. 4 shows an example of recognizing and managing the remained ink amount as for the black ink cartridge, but the control routine repeats the operation of recognizing and managing the remained ink amount in the order of the black, cyan, magenta, and yellow cartridges.

At step S11 in the control routine shown in FIG. 4, whether or not the black ink cartridge is placed is judged. Using the flag data from the ink cartridge detector 46 shown in FIG. 3, the calculation controller 45 judges whether or not the black ink cartridge is placed. If it is not judged that the black ink cartridge is placed (NO at step S11), the ink end is indicated on the display 49. If it is judged that the black ink cartridge is placed (YES at step S11), control goes to step S12 and whether or not other cartridges are in a replacement state is judged.

That is, at step S12, whether or not each of the cyan, magenta, and yellow ink cartridges other than the black ink cartridge is placed is judged. To make the judgment, the flag data from the ink cartridge detector 46 shown in FIG. 3 is also used. If it is judged that none of the cyan, magenta, and yellow ink cartridges are in a replacement state (NO at step S12), control goes to step S13. At step S13, the calculation controller 45 shown in FIG. 3 inputs the data of the ink consumption count (Cb) of the black ink cartridge in the consumed ink counter 44 and sends the data to the verifier 47, which then compares the threshold value set in the threshold determinant 48 with the ink consumption count (Cb).

In the embodiment, level A as a first predetermined value assumed to be the ink end (highest ink consumption level), level B as a second predetermined value less than the first predetermined value, and level C as a third predetermined value assumed to be the near ink end less than the second predetermined value are set in the threshold determinant 48. If it is judged that the ink consumption count of black ink is less than level C, the ink status is set to 0 as shown at step S13. If it is judged that the ink consumption count of black ink is equal to or greater than level C, the ink status is set to 1. In this case, "near ink end" is indicated on the display 49.

Further, if it is judged that the ink consumption count of black ink is equal to or greater than level B, the ink status is set to 2, whereby "near ink end" is indicated on the display 49. Further, if it is judged that the ink consumption count of black ink is equal to or greater than level A, the ink status is set to 3, whereby "ink end" is indicated on the display 49 for requesting the user or the like, to replace the ink cartridge. Thus, the user or the like, can keep track of the progress state of ink consumption of the black ink cartridge.

On the other hand, if any of the cyan, magenta, or yellow ink cartridge is in a replacement state (YES at step S12), control goes to step S14. At step S14, the ink consumption count (Cb) stored in the consumed ink counter 44 is incremented by a predetermined count of "bb" ("bb" is added to black ink consumption count "Cb"), resulting in new consumption count (Cb'). The value of "bb" is a count corresponding to the consumed black ink amount accompanying the ink suction operation executed after the ink cartridge is replaced.

At step S15, the black ink consumption count "Cb" resulting from the adding operation. is sent to the verifier 47, which then compares the black ink consumption count "Cb" with the threshold value set in the threshold determinant 48. If it is judged at step S15 that the black ink consumption count resulting from the adding operation is less than level C, the ink status is set to 0. If it is judged that the black ink consumption count is equal to or greater than level C, the ink status is set to 1. In this case, "near ink end" is indicated on the display 49.

Further, if it is judged that the black ink consumption count is equal to or greater than B of the second predetermined value, the ink status is set to 3, whereby "ink end" is indicated on the display 49 for requesting the user or the like, to replace the ink cartridge.

The described judging operation is executed repeatedly in order corresponding to the ink cartridges placed in the recording apparatus as described above. Therefore, the user or the like, can keep track of the progress state of ink consumption in each of the ink cartridges placed in the recording apparatus according to the display of the display 49. For example, if "ink end" is displayed, the user can recognize that he or she needs to replace the corresponding ink cartridge.

FIGS. 5 to 9 describe the function when the ink cartridge replacement operation is executed according to the control routine shown in FIG. 4. In schematic drawings of FIGS. 5 to 9, the ink consumption count growing as ink of each color ink cartridge is consumed is hatched as in FIGS. 12 to 15 previously described.

Figure 5:
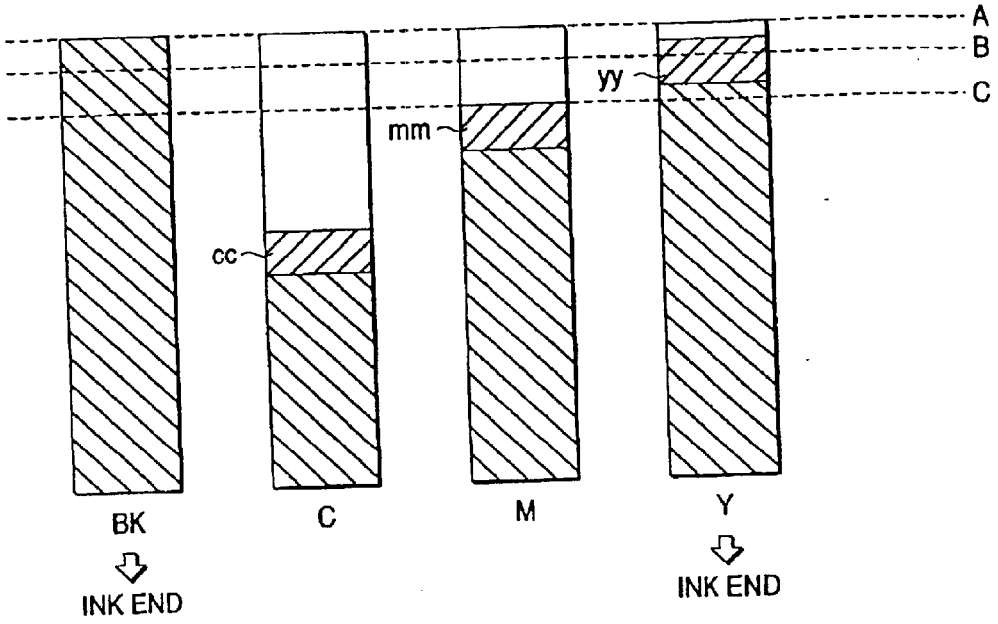
FIGS. 5 through 8 are schematic drawings to show the state of remained ink amount management in each ink cartridge conducted by the control routine shown in FIG. 4.

For example, if the ink consumption count of the black ink cartridge reaches ink end level A of the first predetermined value as shown in FIG. 5, the user replaces the black ink cartridge. As the replacement operation is performed, the ink consumption counts corresponding to other ink cartridges (cyan, magenta, and yellow) are incremented by predetermined counts cc, mm, and yy respectively. The value cc, mm, yy is a count corresponding to the consumed ink amount accompanying the ink suction operation executed after the corresponding ink cartridge is replaced (replacement cleaning), as described above.

In the embodiment, ink end level B of the second predetermined value less than the first predetermined value is set and the incremented count corresponding to each of other cartridges is compared with the ink end level B. In this case, as shown in FIG. 5, the incremented count of the yellow ink cartridge is greater than the ink end level B and thus is judged to be the ink end. Therefore, the user is also requested to replace the yellow ink cartridge and can also replace the yellow ink cartridge at the same time as replacing the black ink cartridge. In fact, the above processing is simultaneously performed when the ink consumption count of the black ink cartridge is in the ink end state of the first predetermined value and the verifier 47 performs the verification as described before. Therefore, the ink end display for the yellow ink cartridge is performed at the same time as the ink end display for the black ink cartridge.

Figure 6:
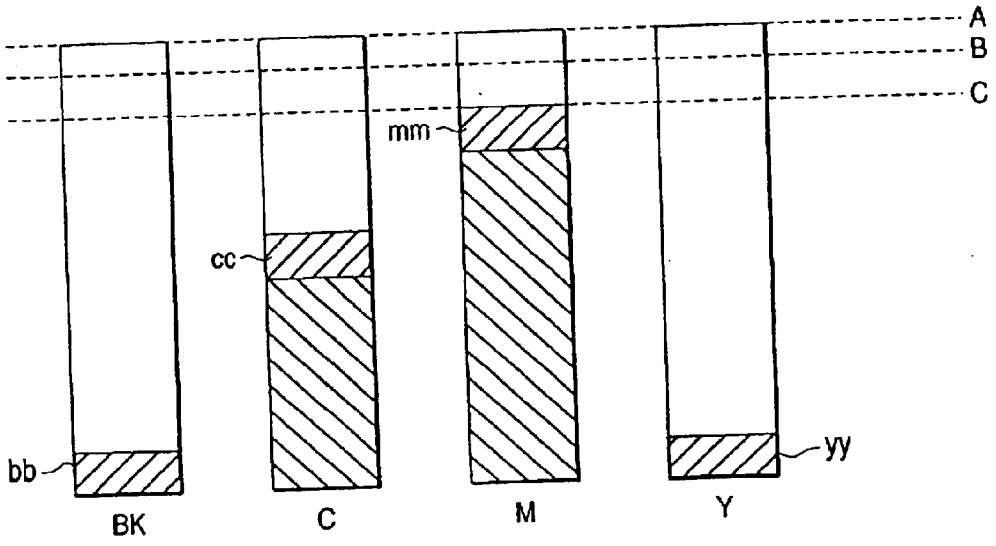

Therefore, the problem for the user to have to replace the yellow ink cartridge again when the yellow ink cartridge is in the ink end state A shortly after replacing the black ink cartridge can be solved. As the black and yellow ink cartridges are replaced, the ink consumption counts of the ink cartridges become as shown in FIG. 6.

Therefore, according to the embodiment, the black and yellow ink cartridges can be replaced at the same time, so that wasting the ink amount corresponding to [(bb+cc+mm)−(level A−level B)] can be avoided as compared with the case where after the black ink cartridge is replaced, replacement cleaning is executed and shortly the yellow ink cartridge is replaced and again replacement cleaning is executed.

Figure 7:
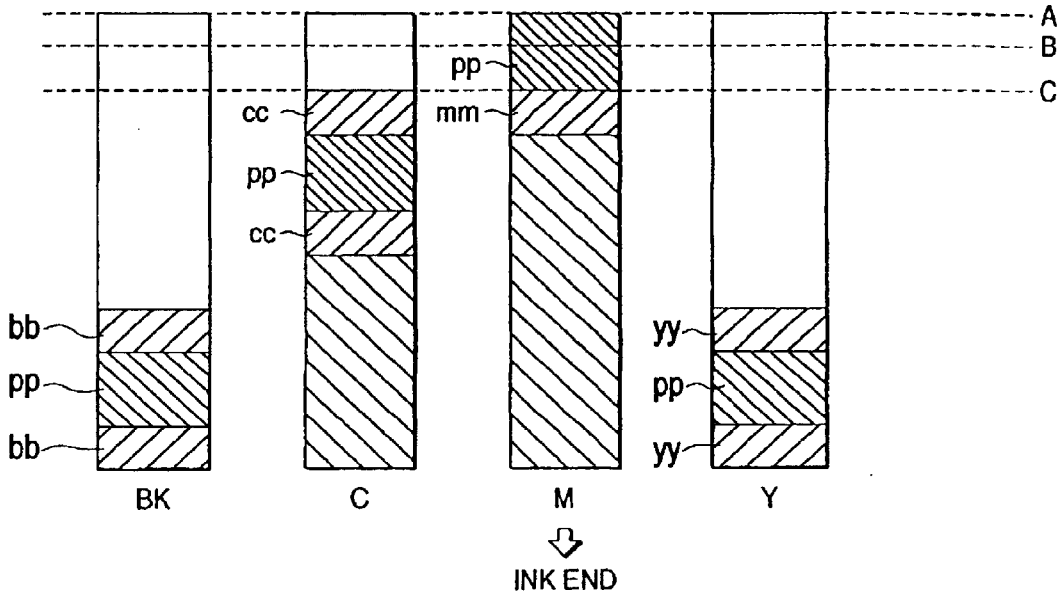
Figure 8:
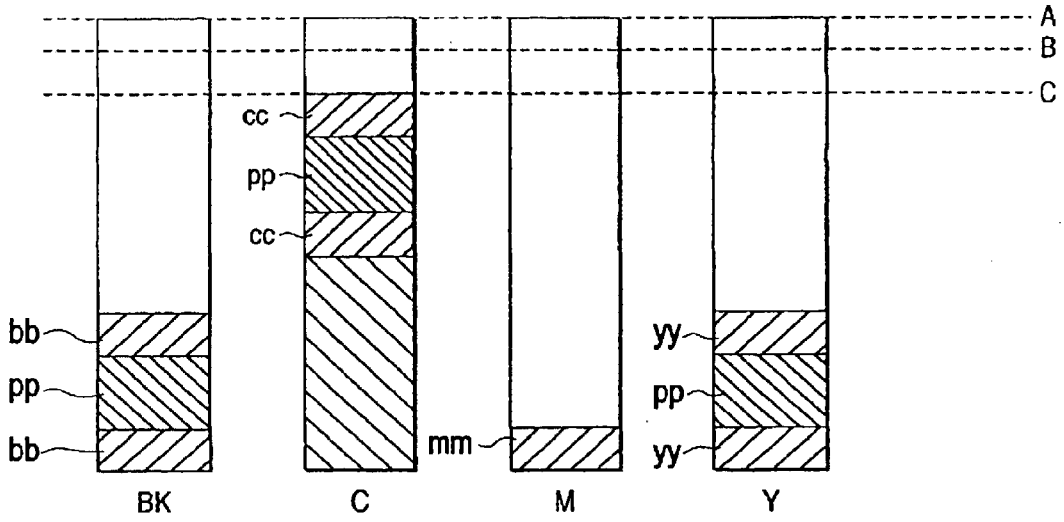

Subsequently, printing is executed, whereby the ink consumption count of each ink cartridge is incremented by pp and the magenta ink cartridge reaches ink end level A as shown in FIG. 7. Then, as the user replaces the magenta ink cartridge, the ink consumption counts corresponding to the ink cartridges (black, cyan, and yellow) other than the magenta ink cartridge are incremented by bb, cc, and yy respectively, as shown in FIG. 8 and printing can be executed subsequently.

It is desirable that the relation between the level difference between the ink end level A and the ink end level B and the predetermined count value C1 (bb, cc, mm, yy) corresponding to the consumed ink amount accompanying the ink suction operation (replacement cleaning) executed after cartridge replacement satisfies the following relationships. Here, m represents number of cartridges placed in recording apparatus.

$$(A-B) \leqq N \cdot C1$$

$$N \leqq m-2$$

That is, as the relation is set as mentioned above, the ink amount wasted by the replacement cleaning executed when any ink cartridge is in the ink end state can be suppressed. Assuming a recording apparatus in which four color ink cartridges of black, yellow, cyan, and magenta are placed, the probability that the three color ink cartridges will reach the ink end at the same time is low. Therefore, setting N becomes practically an appropriate value considering the probability.

On the other hand, it is desirable that the recording apparatus satisfies the following relationship. Here, Cf represents a count value corresponding to consumed ink amount when the recording apparatus is activated or accompanying periodically executed ink suction operation, or count corresponding to consumed ink amount accompanying flushing operation, and n represents a natural number.

$$(A-B) \leqq n \cdot Cf$$

If the recording apparatus is set to the relation, the disadvantage can be circumvented that another ink cartridge is in the ink end state shortly after one ink cartridge is replaced as the initial cleaning operation performed when the apparatus is activated, the timer cleaning operation periodically executed, or the flushing operation periodically performed during the print operation, programmed in the recording apparatus is executed. Therefore, as the recording apparatus is set to the relation, the problem for the user to have to replace an additional ink cartridge as each above-mentioned operation programmed in the recording apparatus is executed can be solved.

In the embodiment, as shown in FIGS. 5 to 8, near ink end level C of the third predetermined value less than the ink end level B of the second predetermined value is defined and when each ink consumption count reaches the near ink end level C, "near ink end" is displayed accordingly. For example, the magenta ink cartridge in FIG. 6 indicates the "near ink end" condition.

If the third predetermined value is set and the ink consumption count exceeds the third predetermined value, a near ink end sign can be output for informing the user that the ink cartridge has some margin (remaining amount) to the ink end. Therefore, the user can recognize that it is possible to print to some extent still after replacing the ink cartridge in the ink end state. In other words, if the user intends to execute a large amount of print, he or she can also replace the ink cartridge reaching the near ink end at the same time.

Figure 9:
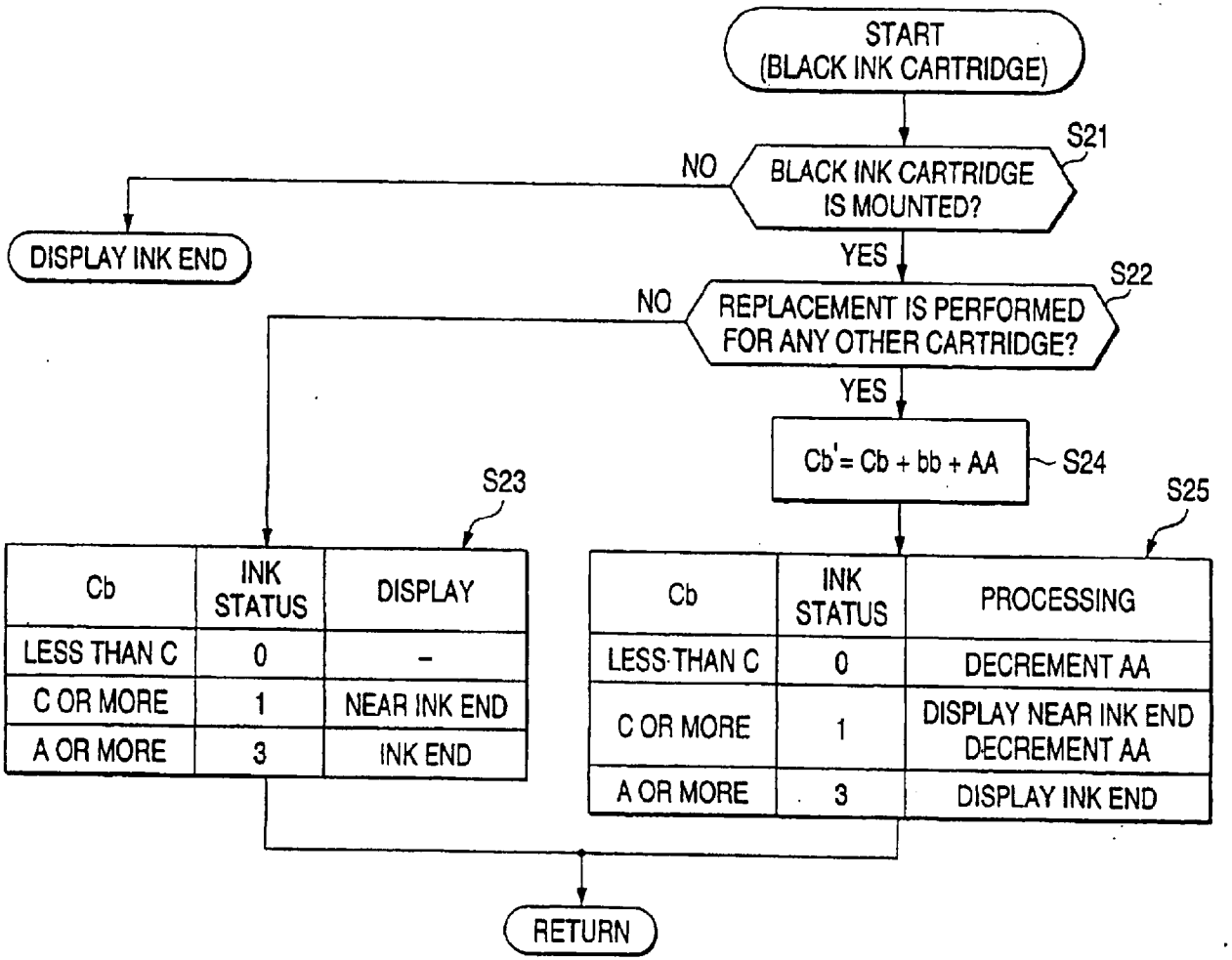
FIG. 9 is a flowchart to show a control routine for executing remained ink amount management in each ink cartridge by the control circuit shown in FIG. 3, according to a second embodiment of the invention.

Next, FIG. 9 shows a control routine for managing the remained ink amount of each ink cartridge according to a second embodiment of the invention. FIG. 9 also shows an example of recognizing and managing the remained ink amount as for the black ink cartridge, but the control routine repeats the operation of recognizing and managing the remained ink amount in the order of the black, cyan, magenta, and yellow cartridges like the control routine in the first embodiment.

In the control routine shown in FIG. 9, ink end level A as a first predetermined value and near ink end level C of a second predetermined value less than the first predetermined value are set. Steps S21 and S22 are similar to steps S11 and S12 previously described with reference to FIG. 4 and therefore will not be discussed again.

At step S23 shown in FIG. 9, the calculation controller 45 shown in FIG. 3 inputs the data of the ink consumption count (Cb) of the black ink cartridge in the consumed ink counter 44 and sends the data to the verifier 47, which then compares the threshold value set in the threshold determinant 48 with the ink consumption count (Cb).

In the embodiment ink end level A as a first predetermined value assumed to be the ink end (highest ink consumption level) and near ink end level C as a second predetermined value assumed to be the near ink end less than the first predetermined value are set in the threshold determinant 48, If it is judged that the ink consumption count of black ink is less than near ink end level C, the ink status is set to 0 as shown at step S23. If it is judged that the ink consumption count of black ink is equal to or greater than near ink end level C, the ink status is set to 1. In this case, "near ink end" is indicated on the display 49.

Further, if it is judged that the ink consumption count of black ink is equal to or greater than ink end level A, the ink status is set to 3, whereby "ink end" is indicated on the display 49. Thus, the user or the like, can keep track of the progress state of ink consumption of the black ink cartridge.

On the other hand, at step S24, the ink consumption count stored in the consumed ink counter 44 is incremented by the sum of a first count value of "bb" and a second count value of "AA," The value of the first count value "bb" is a count corresponding to the consumed black ink amount accompanying the ink suction operation executed after the ink cartridge is replaced. The second count value "AA" is set to a predetermined count corresponding to the ink amount enabling a predetermined amount of printing associated with average print duty in accordance with bit map data given to the recording head.

As the ink consumption count stored in the consumed ink counter 44 is incremented by the predetermined count ("bb"+"AA") as mentioned above, a judgment can be made as to whether or not a predetermined amount of print can be executed still after the ink suction operation accompanying cartridge replacement (replacement cleaning) is executed.

To make the judgment, in the embodiment, at step S25, the value resulting from incrementing the ink consumption count of the ink cartridge "Cb" by the predetermined count "bb+AA" is compared with the ink end level A as the first predetermined value and the near ink end level C as the second predetermined value. If it is judged that the incremented ink consumption count of the black ink cartridge is less than the near ink end level C, the ink status is set to 0. In such a state, it is assumed that sufficient amount of ink is remained. In this case, the incremented ink consumption count is decremented by "AA".

As step S24 is executed, the ink consumption count "Cb" stored in the consumed ink counter 44 is already incremented and therefore is decremented by "AA" for resetting, so that the count manipulated on the algorithm is restored to the count indicating the actual remained ink amount. Accordingly, the reliability of the ink end judging operation continuously executed can be provided.

On the other hand, if it is judged at step S25 that the ink consumption count resulting from the adding operation is equal to or greater than the near ink end level C, the ink status is set to 1. In this case, "near ink end" is indicated on the display 49, and the ink consumption count resulting from the adding operation is decremented by "AA". Further, if it is judged that the ink consumption count is equal to or greater than ink end level A, the ink status is set to 3, whereby "ink end" is indicated on the display 49 for requesting the user or the like, to replace the ink cartridge.

The described judging operation is executed repeatedly in order corresponding to the ink cartridges placed in the recording apparatus as described above. Therefore, the user or the like, can keep track of the progress state of ink consumption in each of the ink cartridges placed in the recording apparatus according to the indication of the display 49. For example, if "ink end" is displayed, the user can recognize that he or she needs to replace the corresponding ink cartridge.

Figure 10:
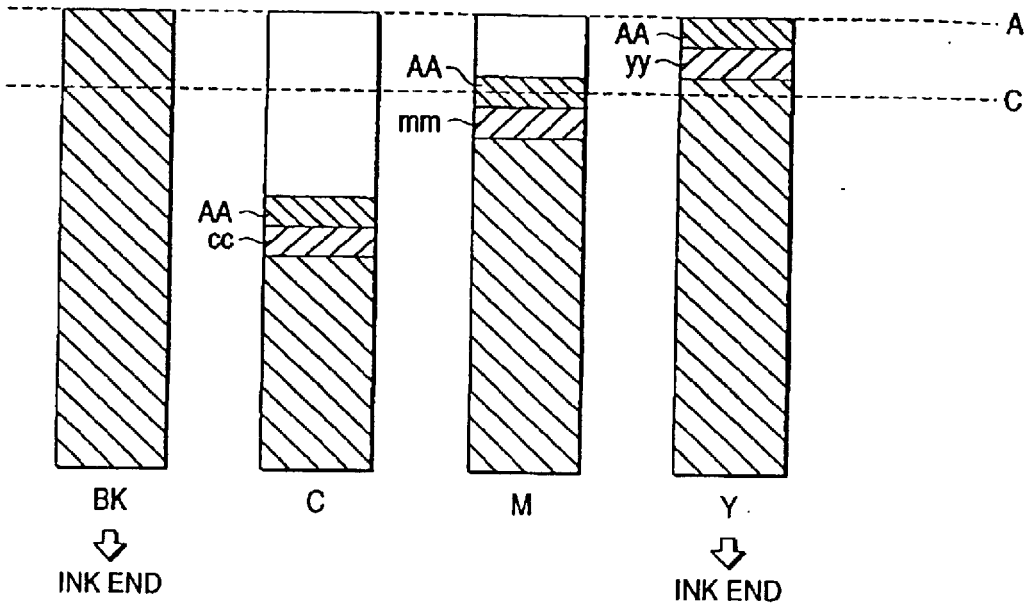
FIGS. 10 and 11 are schematic drawings to show the state of remained ink amount management in each ink cartridge conducted by the control routine shown in FIG. 9.
Figure 11:
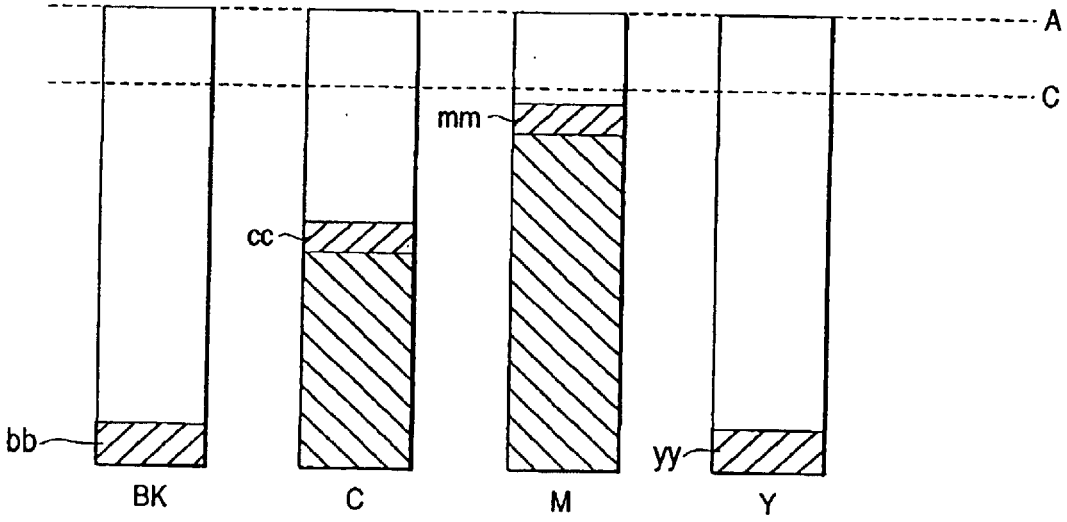
Figure 12:
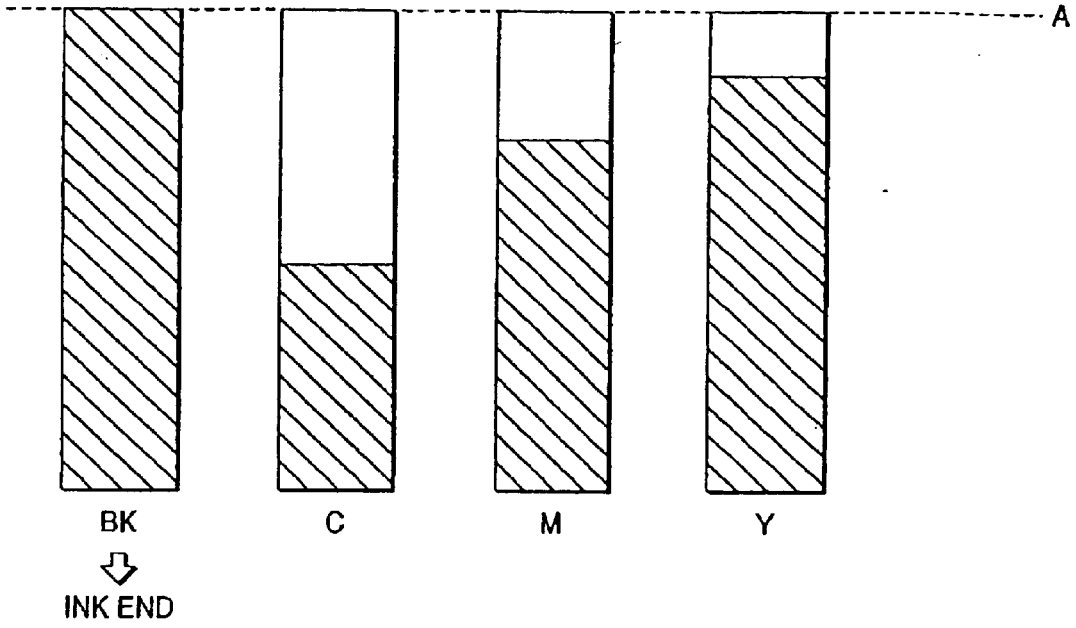
FIG. 12 PRIOR ART
FIGS. 12 through 15 are schematic drawings to show the state of remained ink amount management in each ink cartridge in a related art.
Figure 13:
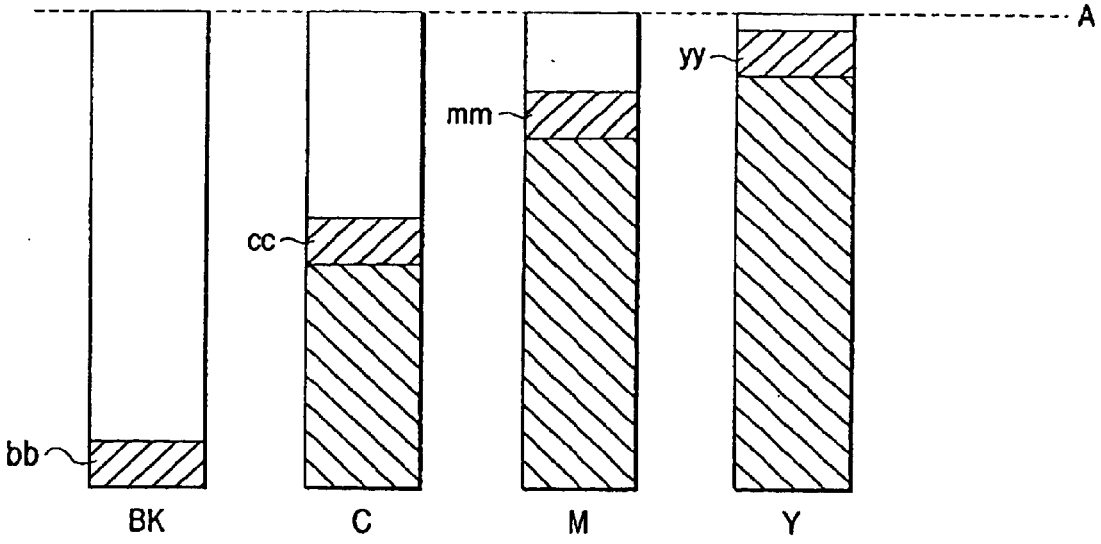
FIG. 13 PRIOR ART
Figure 14:
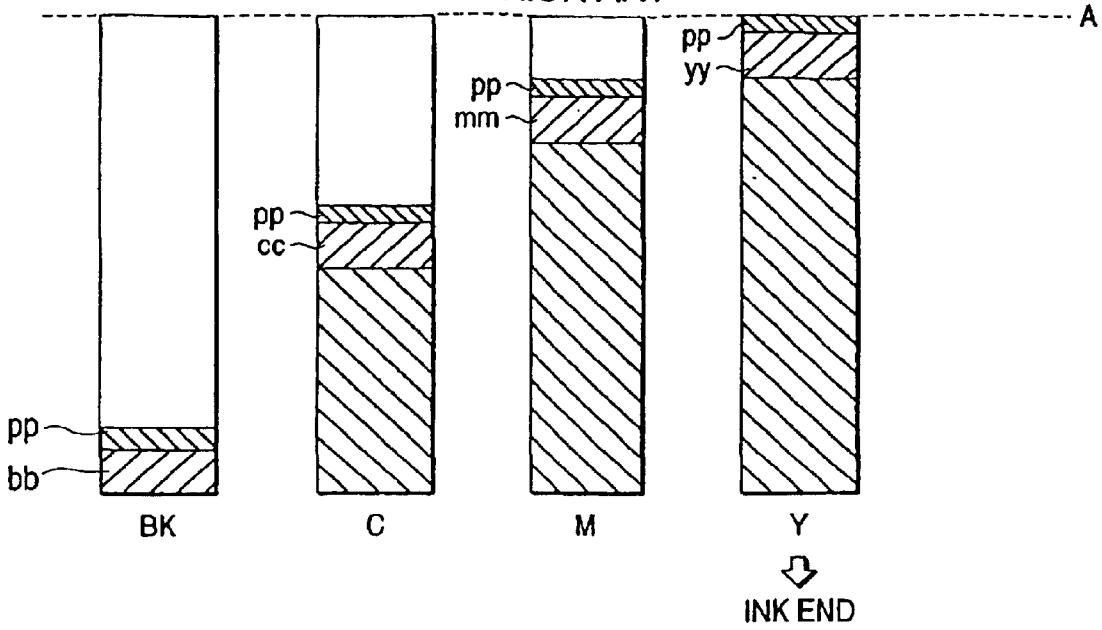
FIG. 14 PRIOR ART
Figure 15:
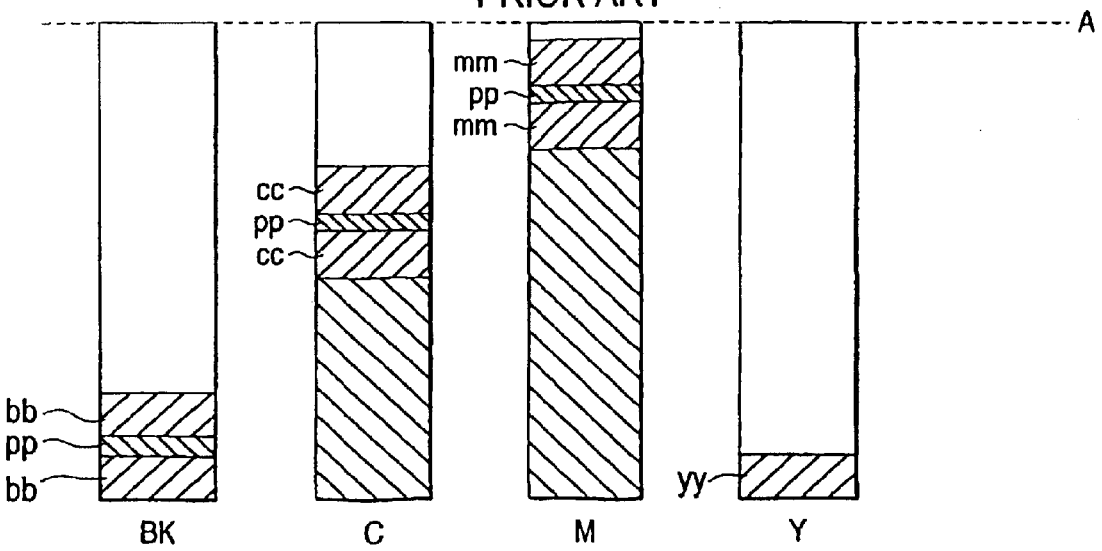
FIG. 15 PRIOR ART

FIGS. 10 and 11 describe the function when the ink cartridge replacement operation is executed according to the control routine shown in FIG. 9. In schematic drawings of FIGS. 10 and 11, the consumed ink amount (ink consumption count) of each color ink cartridge is hatched as in FIGS. 5 to 8 previously described.

For example, if the ink consumption count of the black ink cartridge reaches ink end level A of the first predetermined value as shown in FIG. 10, the user replaces the black ink cartridge. As the replacement operation is performed, the ink consumption counts corresponding to other ink cartridges (cyan, magenta, and yellow) are incremented by predetermined counts cc+AA, mm+AA, and yy+AA respectively.

In the embodiment when the ink consumption count is incremented by each count, whether or not the incremented ink consumption count is in the ink end state A is judged. In the state shown in FIG. 10, the yellow ink cartridge is in the ink end level A and therefore is judged to be the ink end state. Therefore, the user is also requested to replace the yellow ink cartridge and can also replace the yellow ink cartridge at the same time as replacing the black ink cartridge.

Therefore, the problem for the user to have to replace the yellow ink cartridge again when the yellow ink cartridge is in the ink end state A as slight print operation is executed after replacing the black ink cartridge can be solved. As the black and yellow ink cartridges are replaced, the ink consumption counts of the ink cartridges become as shown in FIG. 11.

In the embodiment, near ink end level C of the second predetermined value less than the first predetermined value is set. The incremented count corresponding to any other cartridge not assumed to be the ink end is compared with the near ink end level C. In this case, as shown in FIG. 10, the incremented count of the magenta ink cartridge is greater than the near ink end level C and thus is judged to the near ink end state and "near ink end" is indicated on the display 49. Then, the ink consumption count resulting from the adding operation is decremented by "AA." The count manipulated on the algorithm is restored to the count indicating the actual remained ink amount, so that the reliability of the ink end judging operation continuously executed can be provided.

In this case, the user can be informed that sufficient amount of ink is remained in the ink cartridge with respect to the ink end level. Therefore, the user can recognize that it is possible to print to some extent still after replacing the ink cartridge in the ink end state. In other words, if the user intends to execute a large amount of print, he or she can also replace the ink cartridge reaching the near ink end at the same time.

It is desirable that the relation among the first count value C1 (bb, cc, mm and yy), second count value C2 (AA) and the number m of ink cartridges placed in the recording apparatus satisfies the following relationships. Here, N represents a natural number.

$$C2 \leqq N \cdot C1$$

$$N \leqq m-2$$

As the relation is set as mentioned above, the ink amount wasted by the replacement cleaning executed when any ink cartridge is in the ink end state can be suppressed as with the recording apparatus in the first embodiment.

On the other hand, it is also desirable to satisfy the following relationship. Here, Cf represents a count value corresponding to consumed ink amount when the recording apparatus is activated or accompanying periodically executed ink suction operation, or count corresponding to consumed ink amount accompanying flushing operation, and n represents a natural number.

$$C2 \leqq n \cdot Cf$$

If the recording apparatus is set to the relation, the problem for the user to have to replace an additional ink cartridge as each periodical operation programmed in the recording apparatus is executed can be circumvented as with the recording apparatus in the first embodiment.

In addition, in this embodiment, it is desirable that the second predetermined value should be set so as to satisfy the following relationship.

$$A-C > C1+C2$$

The second predetermined value is set as mentioned above, whereby a cartridge reaching the near ink end state can be recognized. Therefore, as with the recording apparatus in the first embodiment, it is made possible to conduct management so as to also replace the cartridge reaching the near ink end state at the same time, and the problem for the user to have to replace another ink cartridge shortly after replacing one ink cartridge can also be circumvented.

In the description made above, the case where the ink amount counter increments the ink consumption count as ink in each ink cartridge is consumed after one ink cartridge is replaced; whereby the ink end state or the like, is judged is taken as an example, However, the ink end can also be judged as the ink amount counter decrements the ink consumption count as ink in each ink cartridge is consumed. In this case, the relationship between the addition (increment) and the subtraction (decrement) described the above is interpreted as the opposite relationship.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

a recording head, which ejects ink drops;

a plurality of ink cartridges detachably mounted on the ink jet recording apparatus, each ink cartridge containing at least one color of ink to be supplied to the recording head;

a consumed ink amount counter, which counts a consumed ink amount in each ink cartridge;

a verifier, which adds a count value, when the counted consumed ink amount of one ink cartridge reaches a first value indicating an ink end state, to the counted consumed ink amounts of any other ink cartridges, in order to obtain verification count values;

a determinant, which judges, when at least one of the verification count values reaches a second value which is not greater than the first value, that the ink cartridge in which the verification count value reaches the second value is in the ink end state, wherein the following relationships are satisfied:

$$A-B \leqq N \cdot C1$$

$$N \leqq m < 2$$

where A represents the first value; B represents the second value; C1 represents the added count value; N is a natural number, and m is number of the ink cartridge.

2. An ink jet recording apparatus comprising:

a recording head, which ejects ink drops;

a plurality of ink cartridges detachably mounted on the ink jet recording apparatus, each ink cartridge containing at least one color of ink to be supplied to the recording head;

a consumed ink amount counter, which counts a consumed ink amount in each ink cartridge;

a verifier, which adds a count value, when the counted consumed ink amount of one ink cartridge reaches a first value indicating an ink end state, to the counted consumed ink amounts of any other ink cartridges, in order to obtain verification count values;

a determinant, which judges, when at least one of the verification count values reaches a second value which is not greater than the first value, that the ink cartridge in which the verification count value reaches the second value is in the ink end state, wherein the following relationship is satisfied:

$$A-B \leqq n \cdot Cf$$

where A represents the first value; B represents the second value; n represents a natural number; and Cf represents a count value corresponding to an ink amount consumed either one of when the recording apparatus is activated, when an ink suction operation for sucking ink from the recording head is performed or when a flushing operation for idly ejecting ink drops is performed.

3. An ink jet recording apparatus comprising:

a recording head, which ejects ink drops;

a plurality of ink cartridges detachably mounted on the ink jet recording apparatus, each ink cartridge containing at least one color of ink to be supplied to the recording head;

a consumed ink amount counter, which counts a consumed ink amount in each ink cartridge;

a verifier, which adds a count value, when the counted consumed ink amount of one ink cartridge reaches a first value indicating an ink end state, to the counted consumed ink amounts of any other ink cartridges, in order to obtain verification count values;

a determinant, which judges, when at least one of the verification count values reaches a second value which is not greater than the first value, that the ink cartridge in which the verification count value reaches the second value is in the ink end state, wherein the following relationship is satisfied:

$$A-C > C1$$

where A represents the first value; C represents a third value that is less than the second value; and C1represents the added count value.

4. The ink jet recording apparatus as set forth in any one of claims 1, 2, or 3, wherein the added count value corresponds to an ink amount consumed in an ink suction operation for sucking ink from the recording head which is executed after performing replacement of the ink cartridge.

5. The ink jet recording apparatus as set forth in any one of claim 1, 2, or 3, further comprising an indicator which indicates there is at least one ink cartridge which is judged as the ink end state.

6. The ink jet recording apparatus as set forth in claim 3, wherein the determinant judges, when at least one of the verification count values reaches the third value, that the ink cartridge in which the verification count value reaches the third value is a near ink end state which is near to the ink end state.

7. The ink jet recording apparatus as set forth in claim 6, further comprising an indicator which indicates there is at least one ink cartridge which is judged as the near ink end state.

8. The ink jet recording apparatus as set forth in any one of claim 1, 2, or 3, wherein the second value is equal to the first value.

9. The ink jet recording apparatus as set forth in claim 8, wherein the count value is obtained by adding a first count value corresponding to an ink amount consumed in an ink suction operation for sucking ink from the recording head which is executed after performing replacement of the ink cartridge and a second count value corresponding to an ink amount consumed in a specific printing operation.

10. The ink jet recording apparatus as set forth in claim 9, wherein the specific printing operation is associated with a predetermined printing duty.

11. The ink jet recording apparatus as set forth in claim 9, wherein the second count value is substracted from the verification count value to obtain an upgraded count value, when the verification count value is less than the first value.

12. The ink jet recording apparatus as set forth in claim 9, wherein the following relationships are satisfied:

$$C1\ C2 \leqq N \cdot C1$$

$$N \leqq m-2$$

where C1 represents the first count value; C2 represents the second count value; N is a natural number; and m is number of the ink cartridge.

13. The ink jet recording apparatus as set forth in claim 9, wherein the following relationship is satisfied:

$$C2 \leqq n \cdot Cf$$

where C2 represents the second count value; n represents a natural number; and Cf represents a count value corresponding to an ink amount consumed either one of when the recording apparatus is activated, when an ink suction operation for sucking ink from the recording head is performed or when a flushing operation for idly ejecting ink drops is performed.

14. The ink jet recording apparatus as set forth in claim 8, wherein the following relationship is satisfied:

$$A-B>C$$

where A represents the first value; B represents a second value which is less than the first value; and C represents the added count value.

15. The ink jet recording apparatus as set forth in claim 14, wherein the determinant judges, when at least one of the verification count values reaches the second value, that the ink cartridge in which the verification count value reaches the second value is a near ink end state which is near to the ink end state.

16. The ink jet recording apparatus as set forth in claim 15, further comprising an indicator which indicates there is at least one ink cartridge which is judged as the near ink end state.

17. The ink jet recording apparatus as set forth in claim 8, further comprising an indicator which indicates there is at least one ink cartridge which is judged as the ink end state.

18. A method of judging an ink end state of at least one of ink cartridges, detachably mounted on an ink jet recording apparatus, each ink cartridge containing at least one color of ink to be supplied to a recording head, comprising the steps of:

counting a consumed ink amount in each ink cartridge;

adding a count value, when the counted consumed ink amount of one ink cartridge reaches a first value indicating the ink end state, to the counted consumed ink amounts of any other ink cartridges, in order to obtain verification count values; and judging, when at least one of the verification count values reaches a second value which is not greater than the first value, that the ink cartridge in which the verification count value reaches the second value is in the ink end state, wherein the following relationships are satisfied:

$$A-B \leqq N \cdot C1$$

$$N \leqq m-2$$

where A represents the first value; B represents the second value; C1 represents the added count value; N is a natural number, and m is a number of the ink cartridge.

19. A method of judging an ink end state of at least one of ink cartridges, detachably mounted on an ink jet recording apparatus, each ink cartridge containing at least one color of ink to be supplied to a recording head, comprising the steps of:

counting a consumed ink amount in each ink cartridge;

adding a count value, when the counted consumed ink amount of one ink cartridge reaches a first value indicating the ink end state, to the counted consumed ink amounts of any other ink cartridges, in order to obtain verification count values; and judging, when at least one of the verification count values reaches a second value which is not greater than the first value, that the ink cartridge in which the verification count value reaches the second value is in the ink end state, wherein the following relationship is satisfied:

$$A-B \leqq n \cdot Cf$$

where A represents the first value; B represents the second value; n represents a natural number; and Cf represents a count value corresponding to an ink amount consumed either one of when the recording apparatus is activated, when an ink suction operation for sucking ink from the recording head is performed or when a flushing operation for idly ejecting ink drops is performed.

20. A method of judging an ink end state of at least one of ink cartridges, detachably mounted on an ink jet recording apparatus, each ink cartridge containing at least one color of ink to be supplied to a recording head, comprising the steps of:

counting a consumed ink amount in each ink cartridge;

adding a count value, when the counted consumed ink amount of one ink cartridge reaches a first value indicating the ink end state, to the counted consumed ink amounts of any other ink cartridges, in order to obtain verification count values; and judging, when at least one of the verification count values reaches a second value which is not greater than the first value, that the ink cartridge in which the verification count value reaches the second value is in the ink end state, wherein the following relationship is satisfied:

$$A-C>C1$$

wherein A represents the first value; C represents a third value that is less than the second value; and C1 represents the added count value.

21. The judging method as set for the in any one of claim 18, 19, or 20, wherein the second value is equal to the first value.

22. The judging method as set forth in any one of claim 18, 19, or 20, further comprising the step of subtracting a count value from the verification count value to obtain an updated count value, when the verification count value is less than the first value, wherein the subtracted count value corresponds to an ink amount consumed in a specific printing operation.

* * * * *